US007667720B2

(12) United States Patent
Kimura

(10) Patent No.: US 7,667,720 B2
(45) Date of Patent: Feb. 23, 2010

(54) IMAGE DISPLAY DEVICE, DRIVING CIRCUIT AND DRIVING METHOD USED IN SAME

(75) Inventor: Hiroaki Kimura, Kawasaki (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 623 days.

(21) Appl. No.: 11/564,569

(22) Filed: Nov. 29, 2006

(65) Prior Publication Data

US 2007/0120793 A1 May 31, 2007

(30) Foreign Application Priority Data

Nov. 30, 2005 (JP) ..... 2005-347156

(51) Int. Cl.
*G09G 5/10* (2006.01)
*G09G 3/36* (2006.01)

(52) U.S. Cl. ..... 345/690; 345/87; 345/89; 345/98; 345/102

(58) Field of Classification Search ..... 345/87, 345/89, 98–100, 101, 102, 690, 211, 212, 345/213, 214
See application file for complete search history.

(56) References Cited

U.S. PATENT DOCUMENTS 7,035,881 B2 * 4/2006 Tummala et al. ..... 707/204
7,106,350 B2 * 9/2006 Baba et al. ..... 345/691

FOREIGN PATENT DOCUMENTS

JP 2003-186456 A 7/2003

OTHER PUBLICATIONS

Gou Sato, "Frame interpolation technology for displaying moving pictures having more natural images", Homepage "R & D Forefront" Toshiba Review, vol. 59, No. 12, 2004.

* cited by examiner

*Primary Examiner*—Duc Q Dinh
(74) *Attorney, Agent, or Firm*—Sughrue Mion, PLLC

(57) ABSTRACT

An image display device is provided which is capable of improving its image quality when a moving picture is displayed by using a holding-type display panel such as a liquid crystal panel. A display gray-level feature value of each display screen is extracted based on a video input signal. A black inserting signal to set a gray level of a black screen (frame) is generated based on the display gray-level feature value extracted by the displayed brightness extracting section. Based on a video input signal, a control signal is sent out to a source driver and another control signal is sent out to a gate driver and a gray level of a black screen to be inserted among display screens each making up a moving picture is set to a liquid crystal panel based on the black inserting signal generated by the black inserting signal computing section.

18 Claims, 11 Drawing Sheets

When Display Screen is Bright

When Display Screen is Dark

IMAGE DISPLAY DEVICE, DRIVING CIRCUIT AND DRIVING METHOD USED IN SAME

BACKGROUND OF THE INVENTION

1. Field of the Invention

The present invention relates to an image display device, a driving circuit and, a driving method to be used in the image display device and more particularly to the image display device in which, when a moving picture is displayed by using a holding-type display panel such as a liquid crystal panel which holds a current frame until display data corresponding to a succeeding frame is supplied, a black insertion driving operation to insert one black frame between two continuous frames in a repeated manner is performed, and to the driving circuit and driving method to be used in the above image display device.

The present application claims priority of Japanese Patent Application No. 2005-347156 filed on Nov. 30, 2005, which is hereby incorporated by reference.

2. Description of the Related Art

A liquid crystal display device is generally driven in a holding-type manner in which a current frame is held until display data corresponding to a succeeding frame is supplied. As a result, in principle, there is no flicker in the display which can provide easiness on the eyes. In this case, a device used to mainly display a still image, such as a personal computer or a like presents no problem, however, in the case of a display device to display a moving picture such as a liquid crystal television set, a subsequent image is displayed with a current image being still left in the consciousness of a user and, as a result, the current image is perceived by a user as an afterimage. On the other hand, a CRT (Cathode Ray Tube) display device is generally called an "Impulse-type" display device in which, immediately after light is intensively emitted for a moment, light disappears, and nothing is displayed until subsequent displaying starts. This operation is repeated, for example, at the frequency of 60 times per second. Thus, subsequent displaying does not start until an image previously displayed disappears and, therefore, in the case of displaying a moving picture, the persistence of vision is less perceived by a user. Due to this, in a liquid crystal display device, in a liquid crystal television set in particular, in order to achieve the "impulse-type" displaying, an effort to reduce the persistence of vision is being made by inserting one black frame between two continuous frames in a repeated manner.

The conventional liquid crystal display device of this type includes, as shown in FIG. 11, a black insertion driving control section 1, a source driver 2, a gate driver 3, and a liquid crystal panel 4. The liquid crystal panel 4 has data electrodes (not shown), scanning electrodes (not shown), and liquid crystal cells (not shown). In the liquid crystal panel 4, scanning signals "OUT" are sequentially supplied to the scanning electrodes and corresponding pixel data "D" are supplied to the data electrodes and, as a result, corresponding pixel data "D" are fed to corresponding liquid crystal cells in which modulation is then performed on light emitted from a backlight (not shown) to form an image to be displayed. The source driver 2 applies, based on a control signal "a" fed from the black insertion driving control section 1, a voltage for pixel data "D" corresponding to a video input signal "VD" to each of the data electrodes in the liquid crystal panel 4. The gate driver 3 applies a scanning signal "OUT", based on a control signal "b" fed from the black insertion driving control section 1, line-sequentially, to each of the scanning electrodes in the liquid crystal panel 4. The black insertion driving control section 1 sends out, based on the video input signal "VD", a control signal "a" to the source driver 2 and a control signal "b" to the gate driver 3 so as to perform the black insertion driving operation so that one black frame having a gray level of, for example, "0" is inserted between two continuous frames in the liquid crystal panel 4 uniformly and in a repeated manner.

Conventional technologies of this type, in addition to the above conventional liquid crystal display device, are disclosed, for example, in following references.

In the conventional liquid crystal display device disclosed in Patent Reference 1 (Japanese Patent Application Laid-open No. 2003-186456, abstract, FIG. 1), data screen and a black screen appear for one frame period alternately at over twice faster than normal speed. Particularly, in image display for adjacent frames, a black display region and a data display region change their places alternately. As a result, when moving pictures are being displayed, portions in which a response speed is high and portions in which a response speed is low exist in a mixed manner, thus suppressing an image distortion and a feeling of the persistence of vision.

In frame interpolation technology disclosed in Non-Patent Reference 1 (Gou Sato, "Frame interpolation technology for displaying moving pictures having more natural images", Homepage "R & D Forefront" Toshiba Review, Vol. 59 No. 12, 2004), motion estimation is performed base on two original image frames to form interpolated frames which are inserted for one frame period. As a result, each frame maintains brightness with an afterimage being reduced.

However, the above conventional liquid crystal display devices have the problems described below.

That is, in the conventional liquid crystal display device shown in FIG. 11, since black frames are inserted uniformly irrespective of shades of gray set for every frame, though an effect of reducing afterimages at time of displaying moving pictures can be obtained, gray-level displaying effects decrease and contrast is lowered, as a result, making it difficult to achieve sufficient improvement in displaying moving pictures. In order to obtain compatibility between the effect of improving display of moving pictures and the effect of enhancing gray-level displaying and contrast, a great increase in luminance of backlight is required, which causes an increase in manufacturing costs for the backlight and in power consumption.

Also, in the liquid crystal display device disclosed in the Patent Reference 1, data screen and a black screen appear for one frame period alternately at over twice faster than normal speed to suppress the image distortion and feeling of the persistence of vision and, therefore, the object of the invention disclosed in the Patent Reference 1 is very similar to that of the present invention, however, both are different from each other in terms of the configurations of the liquid crystal display device.

In the frame interpolation technology disclosed in the Non-Patent Reference 1, the object of the invention disclosed in the Non-Patent Reference is very similar to that of the present invention, however, additional devices for motion estimation are required in the conventional technology, a problem arises that hardware configurations of the liquid crystal display device become complicated.

SUMMARY OF THE INVENTION

In view of the above, it is an object of the present invention to provide an image display device which is capable of obtaining effects of improving display of moving pictures and of enhancing gray-scale displaying and contrast with comparatively simple structure.

According to a first aspect of the present invention, there is provided an image display device in which a black frame is inserted between a frame making up a moving picture and its succeeding frame, including:

a black frame gray-level controlling section to change a gray level of the black frame to be inserted immediately after the frame, based on a gray level of each frame making up a moving picture.

In the foregoing, a preferable mode is one wherein the black frame gray-level controlling section includes:

a display gray-level feature value extracting section to extract a display gray-level feature value corresponding to a gray level of each frame making up a moving picture; and a black inserting signal computing section to calculate to generate a black inserting signal to set a gray level to the black frame, based on the display gray-level feature value.

Also, a preferable mode is one wherein the display gray-level feature value extracting section is so configured as to extract the display gray-level feature value by detecting frequency of occurrence of a gray level of the frame within one frame space in each frame making up a moving picture and wherein the black inserting signal computing section is so configured as to calculate to generate the black inserting signal having a level corresponding to the display gray-level feature value.

Also, a preferable mode is one wherein the black inserting signal computing section detects a minimum gray level whose frequency of occurrence exceeds a specified threshold value in each of the frames based on the display gray-level feature value extracted by the display gray-level feature value extracting section and calculates to generate the black inserting signal by smoothing the minimum gray level of specified number of the frames.

Also, a preferable mode is one wherein the black frame gray-level controlling section includes:

a display gray-level feature value extracting section to partition each of the frames each making up a moving picture into a plurality of matrix-like blocks and to extract a display gray-level feature value corresponding to a gray level of each of the blocks in each of the frames; and a black inserting signal computing section to calculate to generate a block black inserting signal to set a gray level of the black frame to each of the blocks based on each the display gray-level feature value and to calculate to generate a black inserting signal to set a gray level of the black frame by performing spatial interpolation on each block black inserting signal in each boundary among blocks.

Also, a preferable mode is one wherein the display gray-level feature value extracting section is so configured as to extract the display gray-level feature value based on frequency of occurrence of a gray level of each of the blocks in each of the frames and wherein the black inserting signal computing section is so configured as to detect a minimum gray level whose frequency of occurrence exceeds a specified threshold value in each of blocks in each of frames based on the display gray-level feature value and to calculate to generate the black inserting signal by smoothing the minimum gray level of specified number of the frames.

Also, a preferable mode is one wherein the black frame gray-level controlling section includes:

a display gray-level feature value extracting section to extract the display gray-level feature value by detecting an average value of luminance of each pixel making up each frame within one frame space of each frame making up a moving picture; and a black inserting signal computing section to calculate a black inserting signal to set a gray level of the black frame based on the display gray-level feature value.

Also, a preferable mode is one wherein the black inserting signal computing section is so configured as to calculate to generate the black inserting signal by performing specified conversion on the display gray-level feature value extracted by the display gray-level feature value extracting section.

Also, a preferable mode is one wherein the black frame gray-level controlling section includes:

a display gray-level feature value extracting section to partition each frame making up a moving picture into a plurality of matrix-like blocks and to extract the display gray-level feature value by detecting an average value of luminance of each pixel making up each block in each frame; and a black inserting signal computing section to calculate a block black inserting signal to set a gray level of the black frame to each block based on the display gray-level feature value and to generate a black inserting signal to set a gray level of the black frame by performing spatial interpolation on each block gray-level inserting signal in each boundary among blocks.

According to a second aspect of the present invention, there is provided a driving circuit to be used in an image display device in which a black frame is inserted between a frame making up a moving picture and its succeeding frame, including:

a black frame gray-level controlling section to change a gray level of the black frame to be inserted immediately after the frame, based on a gray level of each frame making up a moving picture.

According to a third aspect of the present invention, there is provided a driving method to be used in an image display device in which a black frame is inserted between a frame making up a moving picture and its succeeding frame, including:

changing a gray level of the black frame to be inserted immediately after the frame, based on a gray level of each of the frames making up the moving picture.

With the above configuration, the black frame gray-level controlling means is provided which changes a gray level of a black frame to be inserted immediately after each frame on which a moving picture is being displayed, based on a gray level of each frame making up the moving picture and, therefore, when the frame is bright, the black frame becomes bright to provide a half-tone screen and, when the frame is dark, the black frame becomes dark, thus enabling the effect of improving display of moving pictures by inserting the black screen (frame) to be maintained, and the decrease in white luminance and in contrast to be prevented.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

An image display device is provided in which a gray level of a black frame to be inserted immediately after a frame in which a moving picture is being displayed changes based on a gray level of each frame making up the moving picture and when the frame is bright, the black frame becomes bright and, when the frame is dark, the black frame becomes dark.

First Embodiment

Figure 1:
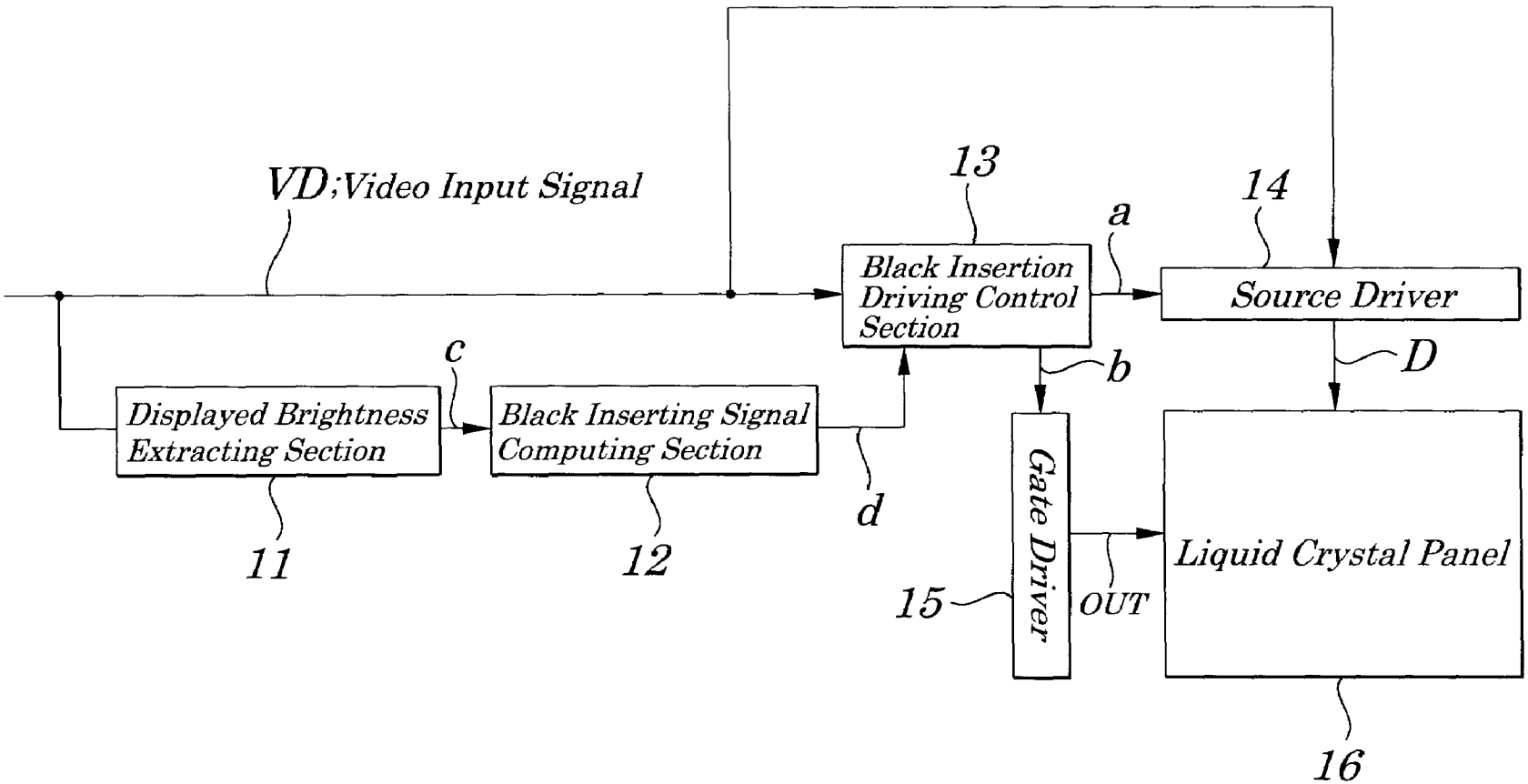
FIG. 1 is a block diagram showing electrical configurations of main components of an image display device according to a first embodiment of the present invention.

FIG. 1 is a block diagram showing electrical configurations of main components of an image display device according to the first embodiment of the present invention. As shown in FIG. 1, a liquid crystal display device serving as the image display device of the first embodiment includes a displayed brightness extracting section 11 as a part component of black frame gray-level controlling section, a black inserting signal computing section 12 as a part component of black frame gray-level controlling section, a black insertion driving control section 13, a source driver 14, a gate driver 15, and a liquid crystal panel 16. The displayed brightness extracting section 11 extracts, based on a video input signal "VD", a display gray-level feature value "c" corresponding to a gray level applied to each display screen (frame) making up a moving picture. The black inserting signal computing section 12 computes to generate, based on the display gray-level feature value "c" fed from the displayed brightness extracting section 11, a black inserting signal "d" used to set a gray level for a black screen (black frame).

The liquid crystal panel 16 has data electrodes (not shown), scanning electrodes (not shown), and liquid crystal cells (not shown). In the liquid crystal panel 16, scanning signals "OUT" are sequentially supplied to the scanning electrodes and corresponding pixel data "D" are supplied to the data electrodes and, as a result, pixel data "D" is fed to corresponding liquid crystal cells in which modulation is then performed on light emitted from a backlight (not shown) to form an images to be displayed and a current frame is held until display data corresponding to a succeeding frame is supplied. The source driver 14 applies, based on a control signal "a" fed from the black insertion driving control section 13, a voltage for pixel data "D" corresponding to a video input signal "VD" to each of the data electrodes in the liquid crystal panel 16.

The gate driver 15 applies a scanning signal "OUT", based on a control signal "b" fed from the black insertion driving control section 13, line-sequentially, to each of the scanning electrodes in the liquid crystal panel 16. The black insertion driving control section 13 sends out, based on the video input signal "VD", a control signal "a" to the source driver 14 and a control signal "b" to the gate driver 15 and sets, based on a black inserting signal "d" generated by computation in the black inserting signal computing section 12, a gray level for each of black screens to be inserted among display screens each making up a moving picture in the liquid crystal panel 16. The above displayed brightness extracting section 11 and black inserting signal computing section 12 make up a black screen gray-level controlling means as a whole, which changes a gray level of each of black screens to be inserted immediately after each display screen on which a moving picture is being displayed, based on a gray level of each of the display screens. The above displayed brightness extracting section 11, black inserting signal computing section 12, black insertion driving control section 13, source driver 14, and gate driver 15 make up the driving circuit.

Figure 2:
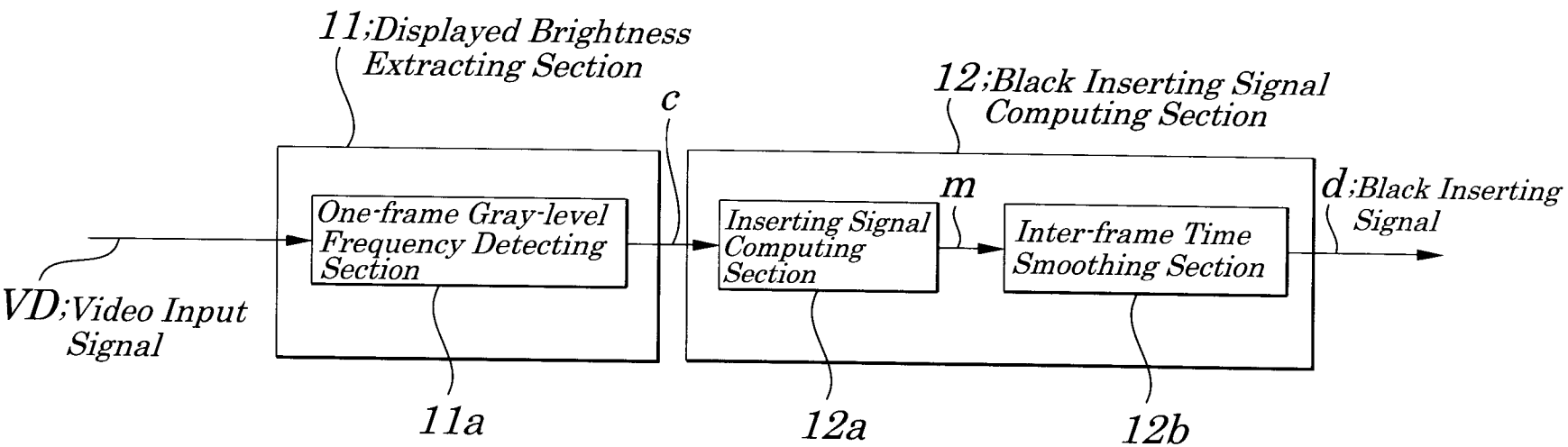
FIG. 2 is a block diagram showing electrical configurations of main components of a displayed brightness extracting section and a black inserting signal computing section according to the first embodiment of the present invention.

FIG. 2 is a block diagram showing electrical configurations of main components of the displayed brightness extracting section 11 and black inserting signal computing section 12. As shown in FIG. 2, the displayed brightness extracting section 11 has a one-frame gray-level frequency detecting section 11*a*. The one-frame gray-level frequency detecting section 11*a* extracts, based on a video input signal "VD", a display gray-level feature value "c" by detecting the frequency of occurrence of gray levels within one-frame space of each of the display screens. In this case, detection of the frequency of occurrence of the gray levels is made, for example, in every other gray level or in every seventeenth gray level or a like.

Also, the black inserting signal computing section 12 is made up of an inserting signal computing section 12*a* and an inter-frame time smoothing section 12*b*. The inserting signal computing section 12*a* detects, based on the display gray-level feature value "c" extracted by the one-frame gray-level frequency detecting section 11*a*, a minimum gray level "m" out of gray levels whose frequency of occurrence exceeds a specified threshold value in each of the display screens. The inter-frame time smoothing section 12*b* computes to generate a black inserting signal "d" by smoothing the minimum gray level "m" of a specified number of display screens (for example, for several frames to several tens of frames). For the smoothing process, a general smoothing operation is performed by using a low-pass filter or by a moving average method.

Figure 3A:
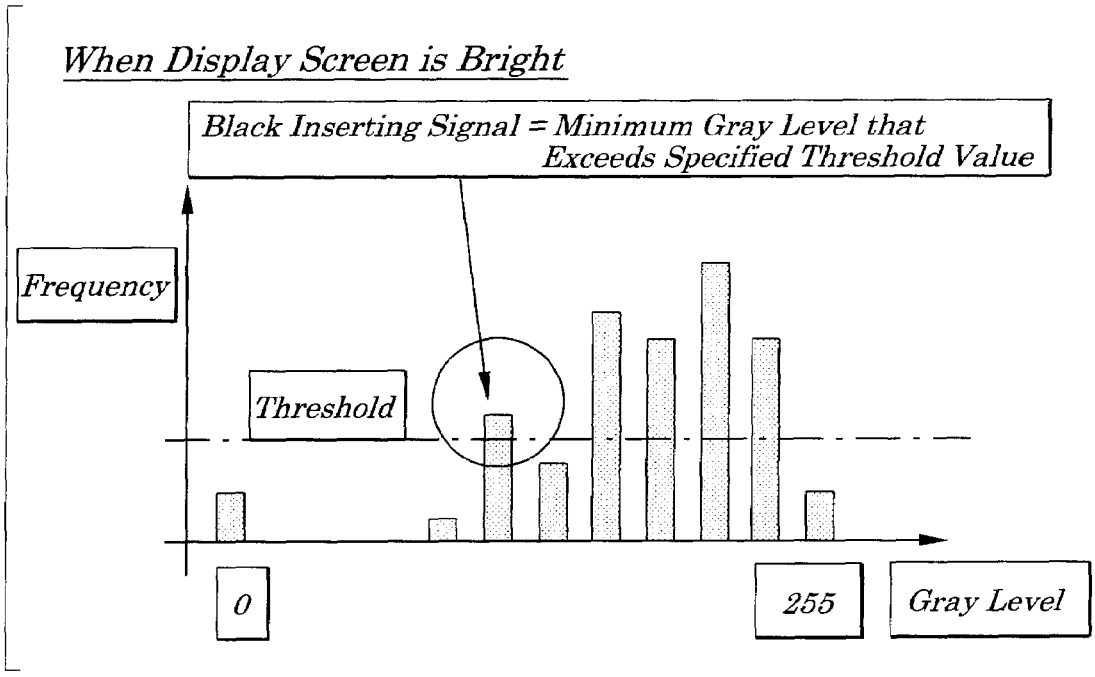
FIGS. 3A and 3B are graphs explaining operations of the displayed brightness extracting section and the black inserting signal computing section according to the first embodiment of the present invention.
Figure 3B:
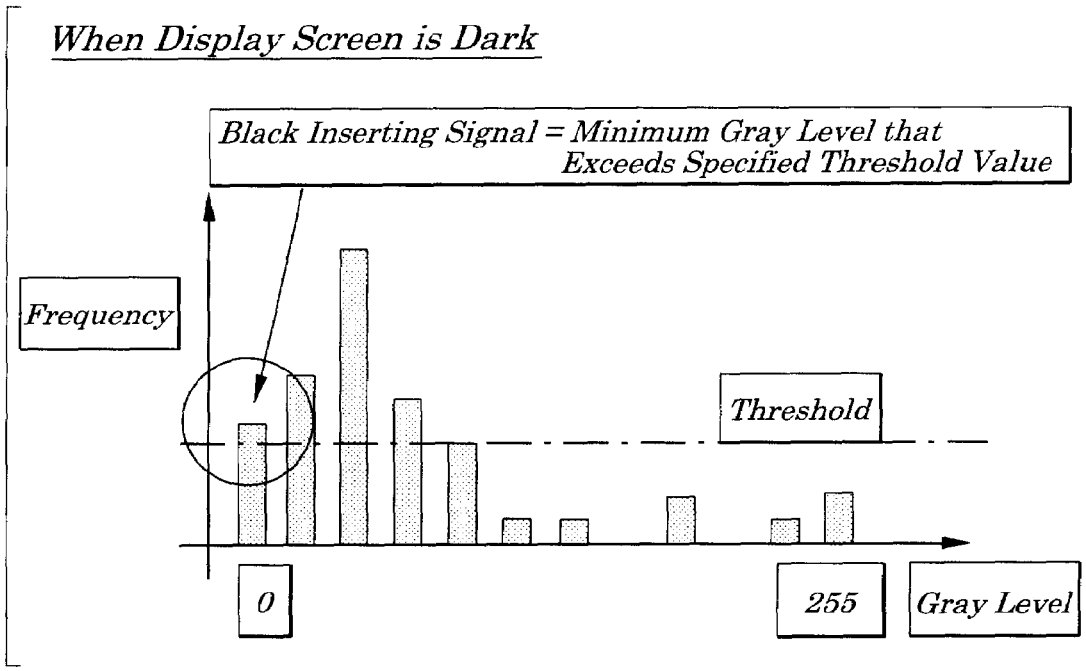
Figure 4A:
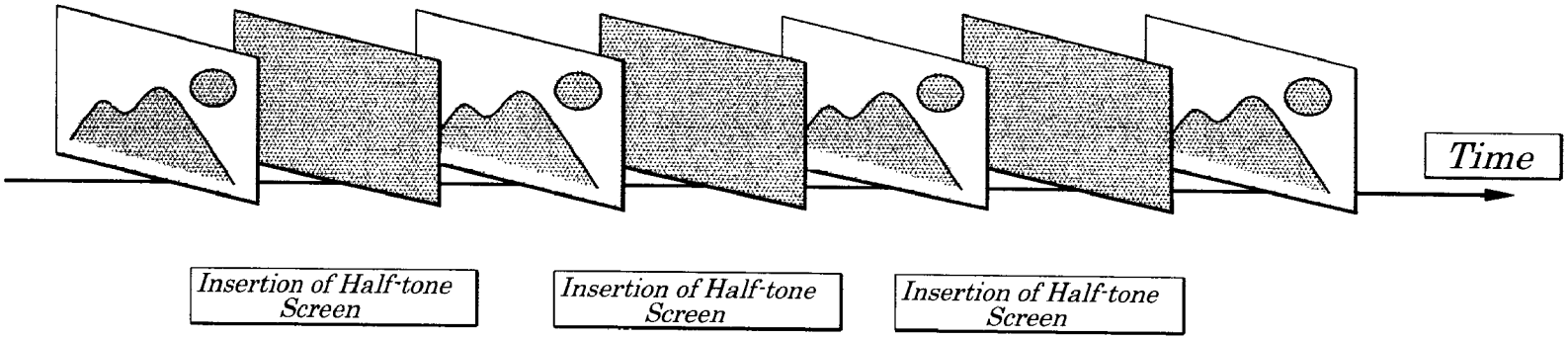
FIGS. 4A and 4B are schematic diagrams explaining a black insertion driving operation.
Figure 4B:
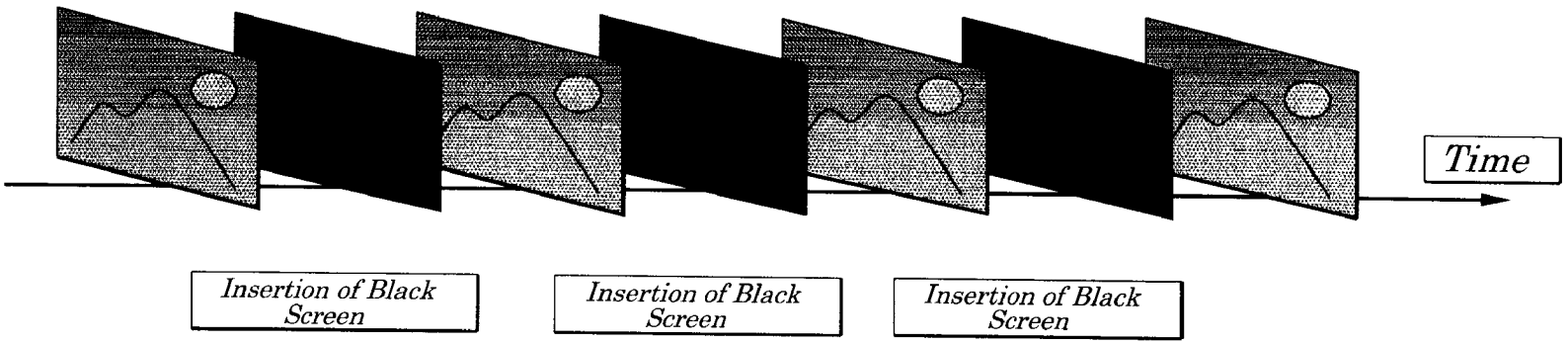
Figure 5A:
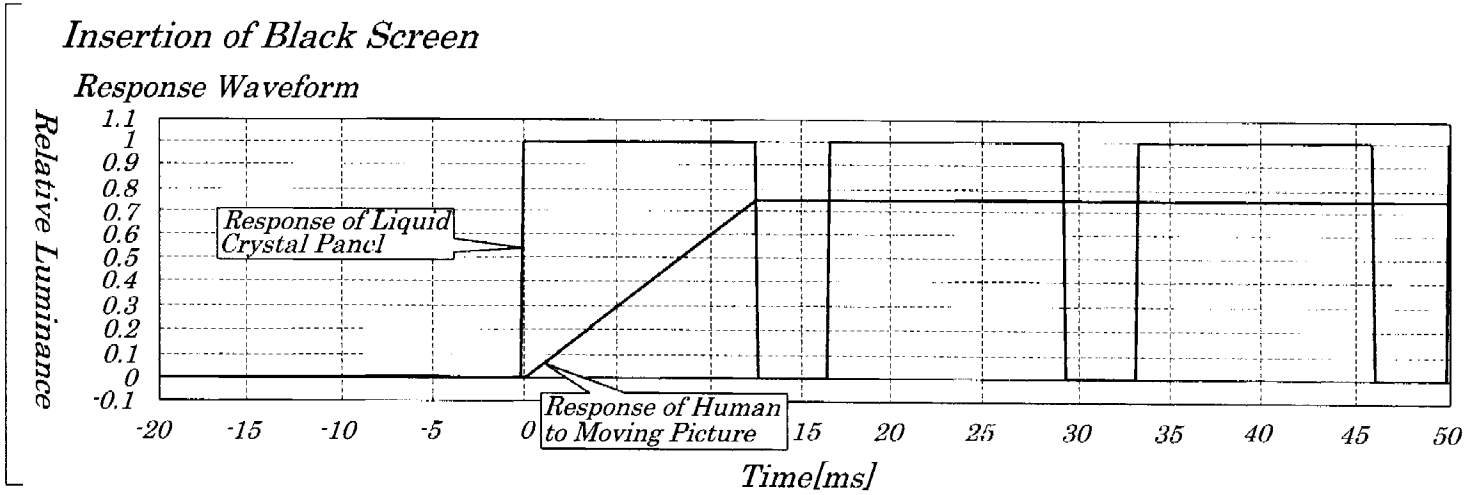
FIGS. 5A and 5B are diagrams showing a relation between a response of a liquid crystal panel at time of inserting a black screen and a half-tone screen and a response of a human perception to a moving picture.
Figure 5B:
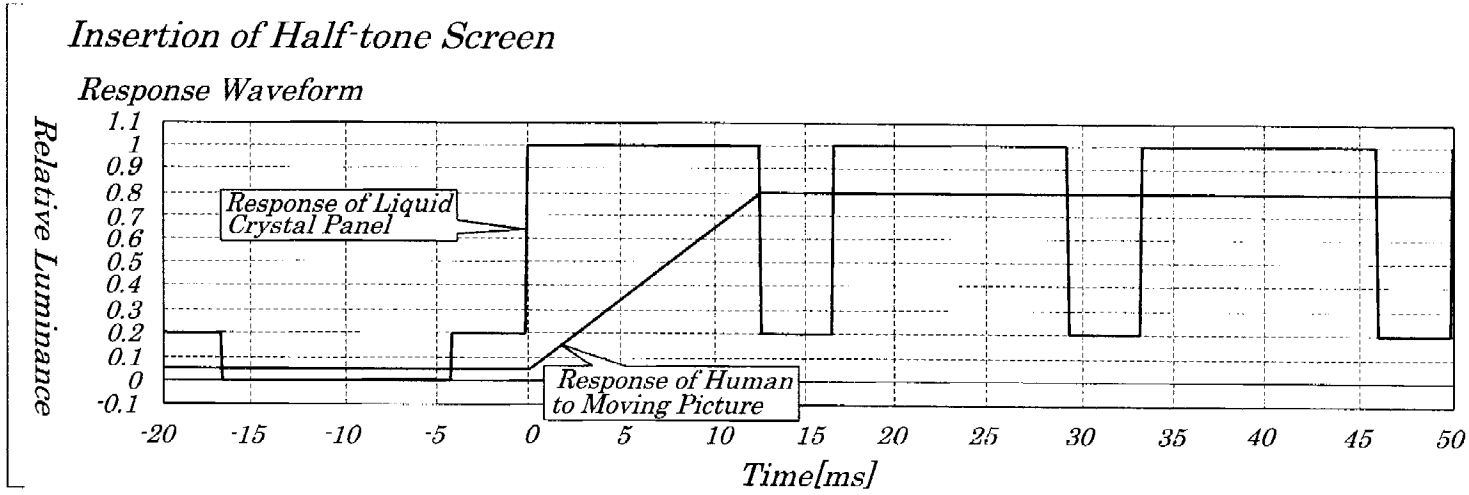
Figure 6A:
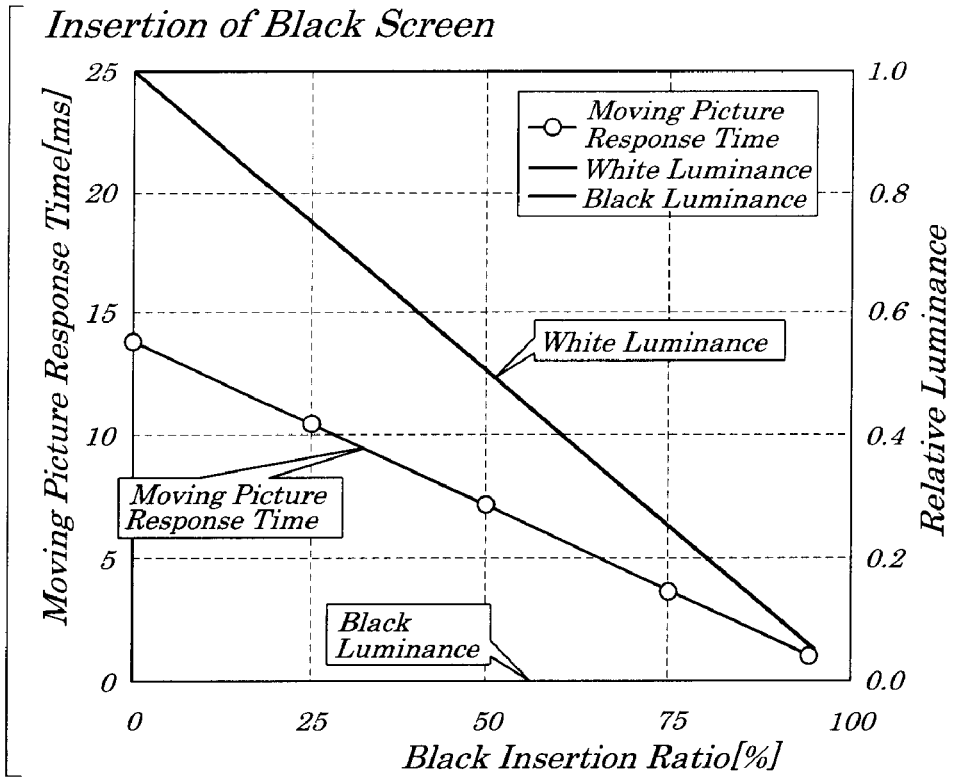
FIGS. 6A and 6B are diagrams showing a relation between white luminance and black luminance at the time of inserting a black screen and a half-tone screen.
Figure 6B:
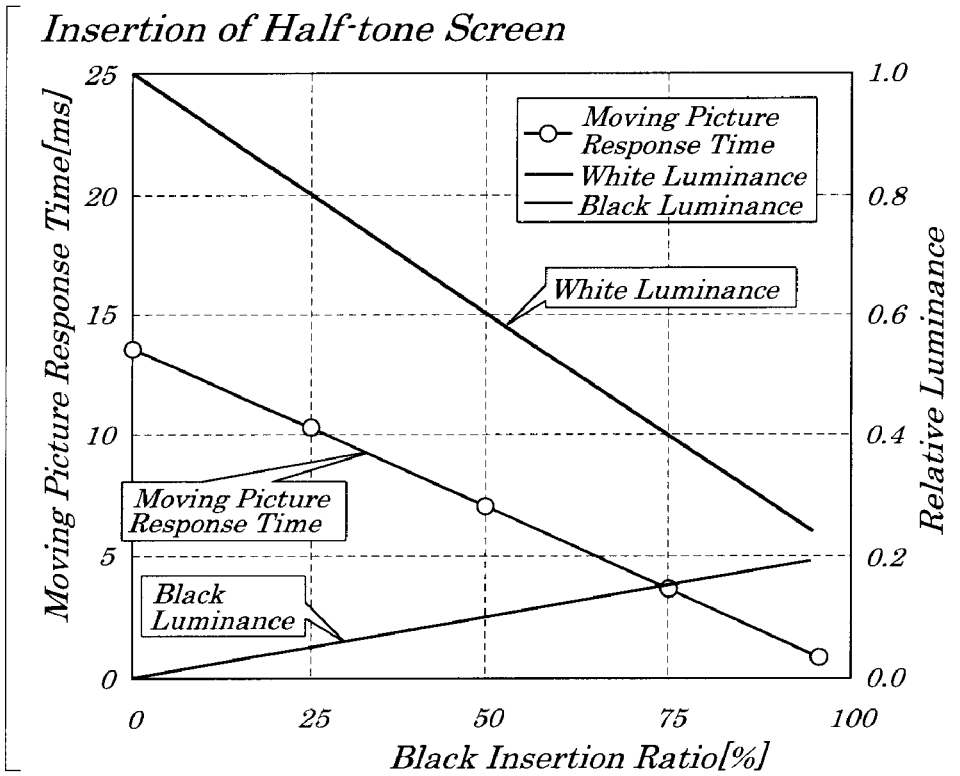

FIGS. 3A and 3B are diagrams explaining operations of the displayed brightness extracting section 11 and the black inserting signal computing section 12. FIGS. 4A and 4B are schematic diagrams explaining black insertion driving operations. FIGS. 5A and 5B are diagrams showing a relation between a response of a liquid crystal panel at time of inserting a black screen and a half-tone screen and a response of human perception to a moving picture. FIGS. 6A and 6B are diagrams showing a relation between white luminance and black luminance at the time of inserting a black screen and a half-tone screen in which a black inserting ratio representing a time ratio of black display to video display is plotted as abscissa and moving picture response time representing a time width of a rise in a waveform of a moving picture and white and black luminance corresponding to the moving picture response time as ordinate. A method of driving the liquid crystal display device of the embodiment is described below by referring to these drawings. In the above liquid crystal display device, a gray level of each of black screens to be inserted immediately after each of display screens is changed based on a gray level of each of the display screen on which a moving picture is being displayed and, when the display screen is bright, the black screen becomes bright and, when the display screen is dark, the black screen becomes dark.

That is, the frequency of occurrence of gray levels within one frame space of each of the display screens is detected and the display gray-level feature value "c" is extracted, based on the video input signal "VD", by the one-frame gray-level frequency detecting section 11*a* in the displayed brightness extracting section 11. As shown in FIG. 3A, the gray-level values in the display gray-level feature "c" (that is, the frequency of occurrence of gray levels in a display area) are distributed in a manner to be leaned to a value distribution region in which the frequency of occurrence of relatively-higher gray levels out of 0 to 255 gray levels is high. In the display gray-level feature "c", a minimum gray level "m" out of gray levels whose frequency of occurrence exceeds a specified threshold value in each of the display screens is detected by the inserting signal computing section 12*a* in the black inserting signal computing section 12. In this case, the detected minimum gray level "m" corresponds to a slightly bright half-tone. The minimum gray level "m" of a specified number of display screens is smoothed by the inter-frame time smoothing section 12*b* and, as a result, a black inserting signal "d" corresponding to the half-tone is output from the inter-frame time smoothing section 12*b*.

On the other hand, as shown in FIG. 3B, when the display screen is dark, the gray-level values in the display gray-level feature "c" are distributed in a manner to be leaned to a value distribution region in which the frequency of occurrence of relatively-higher gray levels out of 0 to 255 gray levels is high. In this case, the detected minimum gray level "m" detected by the inserting signal computing section 12*a* corresponds to a dark gray level. The minimum gray level "m" of a specified number of display screens is smoothed by the inter-frame time smoothing section 12*b* and, as a result, a black inserting signal "d" corresponding to a gray level value almost being 0 level is output from the inter-frame time smoothing section 12*b*.

Thus, the black inserting signals "d" are generated continuously based on brightness of each display screen making up a moving picture to perform the black inserting driving operation and, as shown in FIG. 4A, when a display screen is bright, a half-tone screen is inserted and, as shown in FIG. 4B, when the display screen is dark, a black screen is inserted. Also, even when a bright display screen is changed to be a dark display screen, a black inserting signal "d" is generated in accordance to brightness of a display screen at the time and, therefore, black inserting operations are performed in such a way that a change in brightness is tracked.

When a human views a display screen of a holding-type display panel such as a liquid crystal panel, the human perceives a blur of a moving picture since a human's response speed is lower than a response speed of the liquid crystal panel due to visual tracking effect and visual integration effect (phenomenon of persistence of vision) of human eyes. An amount of the blur can be analyzed by an approximate method based on a response time of a liquid crystal panel as shown in FIGS. 5A and 5B. FIG. 5*a* shows waveforms representing a response of a liquid crystal panel and a response of a human to a moving picture occurred when a black screen is inserted. FIG. 5*b* shows waveforms representing a response of the liquid crystal panel and a response of a human to a moving picture occurred when a half-tone screen is inserted. Comparison of the waveforms shown in FIG. 5A with those shown in FIG. 5B shows that, even if a screen to be inserted changes from the black screen to the half-tone screen, time required for rising of these responses of a human to a moving picture is the same, which does not cause a blur of a moving picture perceived by human eyes.

As shown in FIG. 6A, in the case of general black screen insertion, an increase in a black insertion ratio causes moving picture response time to be shortened, thereby improving a blur of a moving picture, which, however, causes white luminance to be decreased and, as a result, a blur of a moving picture cannot be sufficiently improved. Also, as shown in FIG. 6B, in the case of inserting a half-tone screen, the moving picture response time is the same as in the case of the general black screen insertion shown in FIG. 6A, however, white luminance increases in proportion to brightness of a screen to be inserted. This shows that a decrease in white luminance is suppressed by inserting a half-tone screen instead of inserting a black screen. On the other hand, if a half-tone screen is uniformly inserted, black luminance increases, which causes a decrease in contrast. Therefore, in the first embodiment, if a display screen is bright, white luminance is increased by inserting a half-tone screen and, if the display is dark, the decrease in contrast is suppressed by inserting a black screen.

Thus, according to the first embodiment, a gray level of a black screen to be inserted immediately after each display screen on which a moving picture is being displayed, based on a gray level of each of the display screens making up the moving picture, is changed so that, if the display screen is bright, the inserted black screen is made light to serve as a half-tone screen and, if the display screen is dark, the inserted black screen is made dark to serve as a black screen and, therefore, the effect of improving display of moving pictures by inserting the black screen is maintained, and the decrease in white luminance and in contrast can be suppressed.

Second Embodiment

Figure 7:
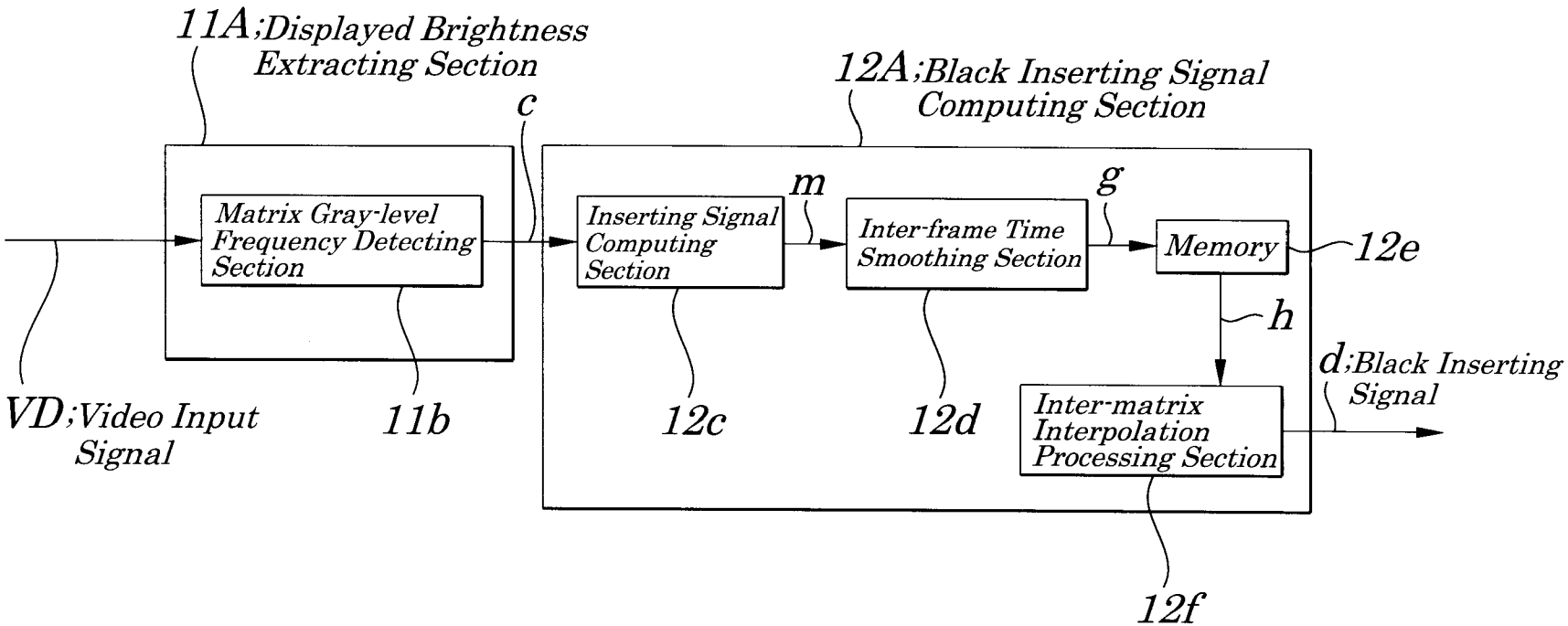
FIG. 7 is a block diagram showing electrical configurations of main components of a driving circuit to be used for a liquid crystal display device of a second embodiment of the present invention.

FIG. 7 is a block diagram showing electrical configurations of main components of a driving circuit to be used for a liquid crystal display device according to the second embodiment of the present invention. In FIG. 7, same reference numbers are assigned to components having the same functions as those in the first embodiment shown in FIG. 2. The driving circuit of the second embodiment includes, as shown in FIG. 7, a displayed brightness extracting section 11A and a black inserting signal computing section 12A, both of which are provided instead of a displayed brightness extracting section 11 and a black inserting signal computing section 12 shown in FIG. 1, respectively. The displayed brightness extracting section 11A has a matrix gray-level frequency detecting section 11*b*. The matrix gray-level frequency detecting section 11*b* partitions each display screen into a plurality of matrix-like blocks based on a video input signal VD and extracts a display gray-level feature value "c" corresponding to a gray level of each block contained in each of the display screen for every block. In the second embodiment in particular, the matrix gray-level frequency detecting section 11*b* extracts the display gray-level feature value "c" based on frequency of a gray level for each block of each frame.

The black inserting signal computing section 12A includes an inserting signal computing section 12*c*, an inter-frame time smoothing section 12*d*, a memory 12*e*, and an inter-matrix interpolation processing section 12*f*. The inserting signal computing section 12*c* detects, based on the display gray-level feature value "c" extracted by the matrix gray-level frequency detecting section 11*b* of the displayed brightness extracting section 11A, a minimum gray level "m" out of gray levels whose frequency of occurrence exceeds a specified threshold value in each block of each of the display screens. The inter-frame time smoothing section 12*d* generates, by computation, a block black inserting signal "g" used to set a gray level of a black screen (black frame) for every block by smoothing the minimum gray level "m" of a specified number of display screens (for example, for several frames to several tens of frames). The memory 12*e* stores a block black inserting signal "g" in each of the blocks. The inter-matrix interpolation processing section 12*f* reads out the block black inserting signal "g" stored in the memory 12*e* as a block black inserting signal "h" and generates a black inserting signal "d" used to set a gray level of a black screen by performing spatial interpolation on the block black inserting signal "h" in each boundary among blocks. If the spatial interpolation in each boundary among blocks is used, it is preferable that neither inflected portions nor discontinuous portions occur, however, any other method may be employed according to capabilities or costs of the display device including a method of general linear interpolation or of setting a specified value in each block.

Figure 8:
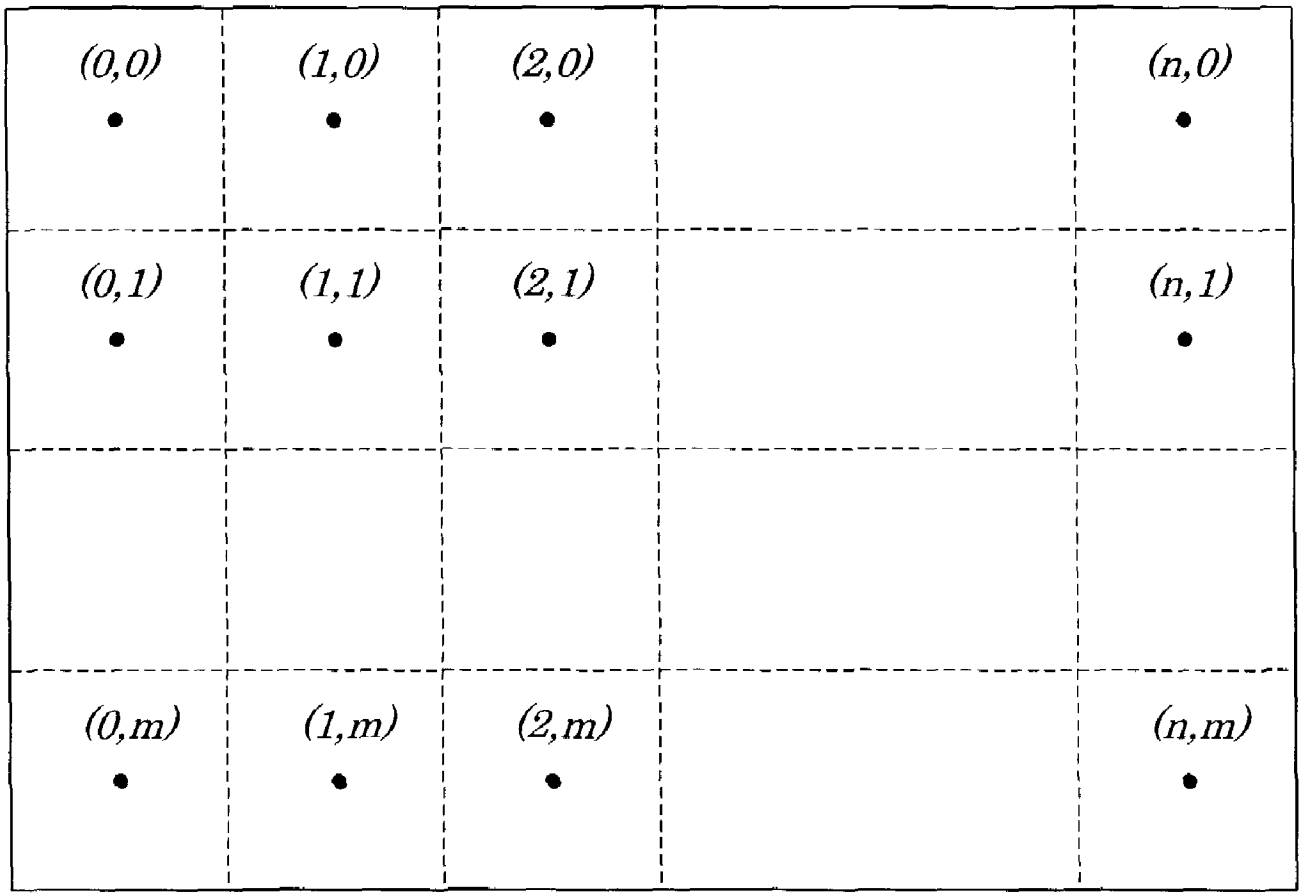
FIG. 8 is a schematic diagram showing a display screen which has been partitioned into a plurality of matrix-like blocks according to the second embodiment of the present invention.

FIG. 8 is a schematic diagram showing a display screen which has been partitioned into a plurality of matrix-like blocks. Processes in the driving method to be employed in the liquid crystal display device of the second embodiment are described by referring to FIG. 8. In the liquid crystal display device, as shown in FIG. 8, each display screen is partitioned, based on a video input signal "VD", into n×m ("n" and "m" are integers being two or more) blocks, by the matrix-level frequency detecting section 11*b* of the displayed brightness extracting section 11A and the display gray-level feature value "c" corresponding to a gray level of each block making up each display screen is extracted in each of the blocks also by the matrix-level frequency detecting section 11*b*. The block black inserting signal "g" used to set a gray level of a black screen in each block is generated by the black inserting signal computing section 12A, based on the display gray-level feature "c" and the block black inserting signal "g" is interpolated spatially in each boundary among blocks to generate a black inserting signal "d". Based on the black inserting signal "d", a gray level of a black screen is set by a black insertion driving control section 13 (not shown in FIG. 7, see FIG. 1). Therefore, even in the case where brightness of a display screen is biased from place to place within the display screen, black is inserted in accordance to the positional biasing to achieve suitable setting of a gray level of the black screen at any place within the display screen.

Third Embodiment

Figure 9:
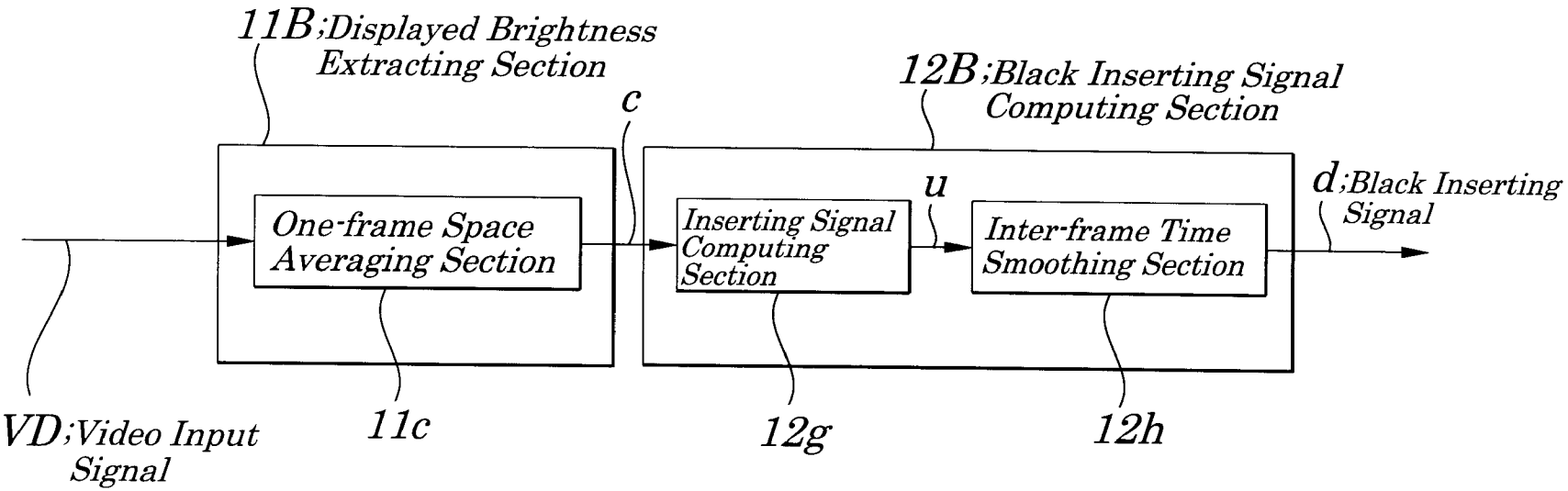
FIG. 9 is a block diagram showing electrical configurations of main components of a driving circuit to be used for a liquid crystal display device according to a third embodiment of the present invention.

FIG. 9 is a block diagram showing electrical configurations of main components of a driving circuit to be used for a liquid crystal display device according to the third embodiment of the present invention. The driving circuit of the third embodiment includes, as shown in FIG. 9, a displayed brightness extracting section 11B and a black inserting signal computing section 12B, both of which are provided instead of a displayed brightness extracting section 11 and the black inserting signal computing section 12 respectively. The displayed brightness extracting section 11B has a one-frame space averaging section 11*c*. The one-frame space averaging section 11*c* extracts, based on a video input signal "VD", a display gray-level feature value "c" by detecting an average value of luminance of each pixel making up each display screen within one-frame space of each of display screens.

The black inserting signal computing section 12B is made up of an inserting signal computing section 12*g* and an inter-frame time smoothing section 12*h*. The inserting signal computing section 12*g* computes to generate one frame black inserting signal "u" corresponding to one-frame space by performing a specified conversion on a display gray-level feature "c" extracted by the one-frame space averaging section 11*c* of the displayed brightness extracting section 11B. This conversion may be achieved by any method including use of a specified operational formula that associates the display gray-level feature "c" with a black inserting signal "d", an LUT (Look Up Table) or a like. The inter-frame time smoothing section 12*h* computes to generate a black inserting signal "d" by smoothing one frame black inserting signal "u" in a specified number of display screens (for example, for several frames to several tens of frames).

In the liquid crystal display device of the third embodiment, an average value is detected by the one-frame space averaging section 11*c* of the displayed brightness extracting section 11B to extract a display gray-level feature value "c" and a specified conversion is performed on the display gray-level feature value "c" by the inserting signal computing section 12*g* to generate the one-frame black inserting signal "u". Therefore, the same effect as obtained in the first embodiment can be achieved with comparatively simple configurations.

Fourth Embodiment

Figure 10:
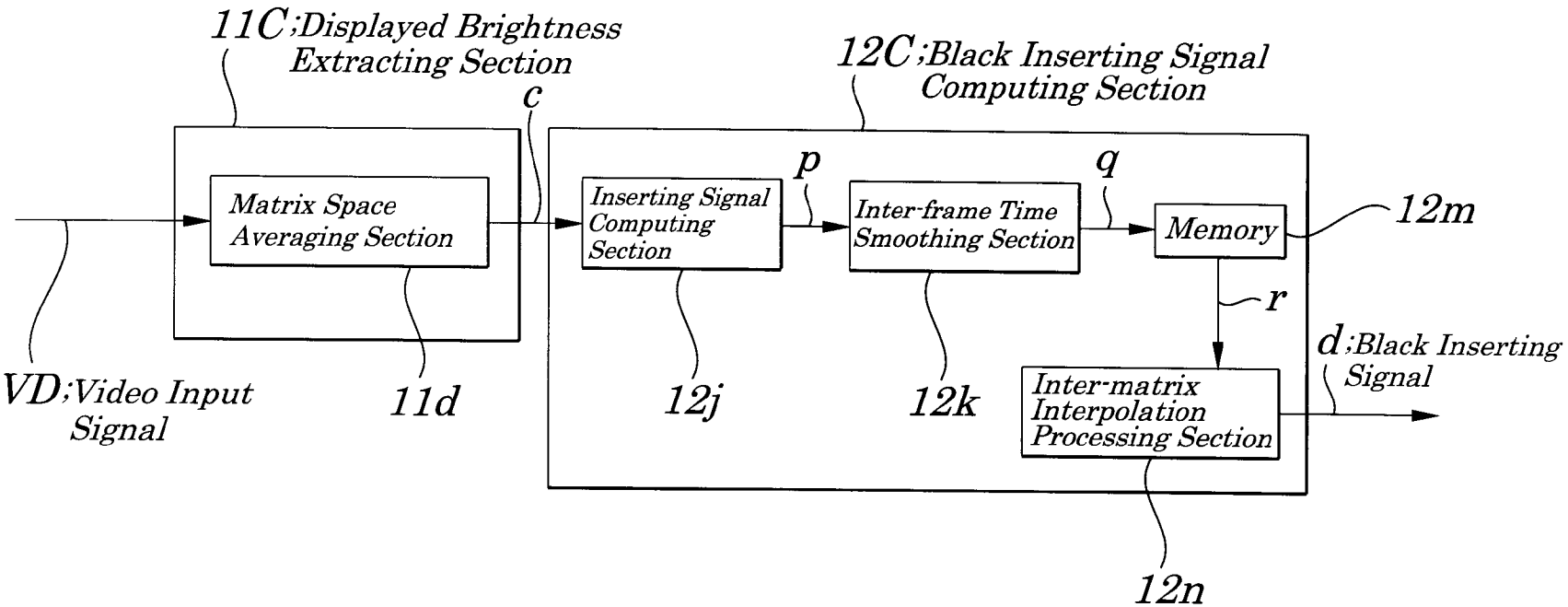
FIG. 10 is a block diagram showing electrical configurations of main components of a driving circuit to be used for a liquid crystal display device according to a fourth embodiment of the present invention.
Figure 11:
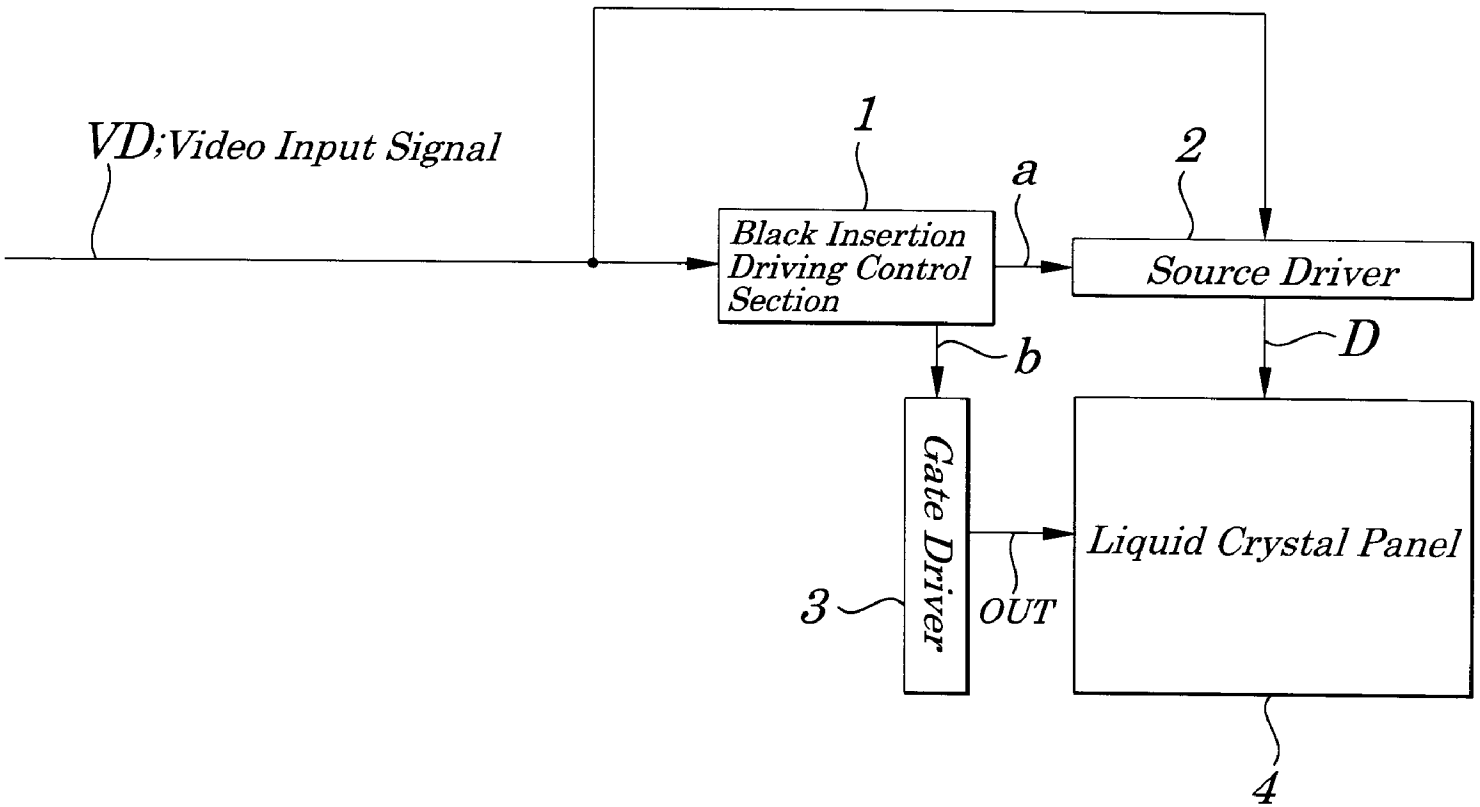
FIG. 11 (RELATED ART)
FIG. 11 is a diagram showing electrical configurations of main components of a conventional liquid crystal display device.

FIG. 10 is a block diagram for showing electrical configurations of main components of a driving circuit to be used for a liquid crystal display device according to the fourth embodiment of the present invention. The driving circuit of the fourth embodiment includes, as shown in FIG. 10, a displayed brightness extracting section 11C and a black inserting signal computing section 12C, both of which are provided instead of a displayed brightness extracting section 11 and a black inserting signal computing section 12 respectively. The displayed brightness extracting section 11C has a matrix space averaging section 11*d*. The matrix space averaging section 11*d* partitions each display screen into a plurality of matrix-like blocks and extracts a display gray-level feature value "c" by detecting an average value of luminance of each pixel making up each block within each of the display screens.

The black inserting signal computing section 12C includes an inserting signal computing section 12*j*, an inter-frame time smoothing section 12*k*, a memory 12*m*, an inter-matrix interpolation processing section 12*n*. The inserting signal computing section 12*j* detects, based on the display gray-level feature value "c" extracted by the matrix space averaging section 11*d* of the displayed brightness extracting section 11C, a minimum gray level "p" out of gray levels at which an average value of luminance of each pixel making up each block in each of the display screens exceeds a specified threshold value. The inter-frame time smoothing section 12*k* generates, by computation, a block black inserting signal "q" used to set a gray level of a black screen (black frame) for every block by smoothing the minimum gray level "p" of a specified number of display screens (for example, for several frames to several tens of frames). The memory 12*m* stores a block black inserting signal "q" in each of the blocks. The inter-matrix interpolation processing section 12*n* reads out the block black inserting signal "q" stored in the memory 12*m* as a block black inserting signal "r" and generates a black inserting signal "d" used to set a gray level of a black screen by performing spatial interpolation on the block black inserting signal "r" in each boundary among blocks.

In the liquid crystal display device of the fourth embodiment, as in the case of the second embodiment shown in FIG. 8, each display screen is partitioned, based on a video input signal "VD", into n×m ("n" and "m" are integers being two or more) blocks, by the matrix space averaging section 11*d* of the displayed brightness extracting section 11C and the display gray-level feature value "c" corresponding to an average value of luminance of each pixel making up each block in each of the display screens is extracted also by the matrix space averaging section 11*d*. In the black inserting signal computing section 12C, the block black inserting signal "q" used to set a gray level of a black screen to each block is generated by computation in every block and the black inserting signal "d" is generated by computation by performing spatial interpolation on each block black inserting signal "q" in each boundary among blocks. Based on the black inserting signal "d", a gray level of a black screen is set by a black insertion driving control section 13 (not shown in FIG. 10, see FIG. 1). Therefore, even in the case where brightness of the display screen is biased from place to place within the display screen, black is inserted in accordance to the positional biasing to achieve suitable setting of a gray level of a black screen at any place within the display screen.

It is apparent that the present invention is not limited to the above embodiments but may be changed and modified without departing from the scope and spirit of the invention.

The present invention can be applied to the image display device in which, when a moving picture is displayed by using a holding-type display panel which holds a current frame until display data corresponding to a succeeding frame is supplied.

What is claimed is:

1. An image display device in which a black frame is inserted between a first and a second frame, said second frame succeeding the first frame, wherein the frames make up a moving picture, comprising:

a black frame gray-level controlling section to change a gray level of said black frame to be inserted immediately after said first frame based on a gray level of said first frame, wherein said black frame gray-level controlling section comprises, a display gray-level feature value extracting section to extract a display gray-level feature value corresponding to the gray level of the first frame; and a black inserting signal computing section to calculate and generate a black inserting signal to set a gray level to said black frame based on said display gray-level feature value.

2. The image display device according to claim 1, wherein said display gray-level feature value extracting section is so configured as to extract said display gray-level feature value by detecting frequency of occurrence of a gray level of each frame within one frame space of said first frame and wherein said black inserting signal computing section is so configured as to calculate and generate said black inserting signal having a level corresponding to said display gray-level feature value.

3. The image display device according to claim 2, wherein said black inserting signal computing section detects a minimum gray level whose frequency of occurrence exceeds a specified threshold value in each frame of said moving picture based on said display gray-level feature value extracted by said display gray-level feature value extracting section and said black inserting computing section calculates and generates said black inserting signal by smoothing said minimum gray level of a specified number frames of said moving picture.

4. The image display device according to claim 1, wherein said black frame gray-level controlling section comprises:

a display gray-level feature value extracting section to extract said display gray-level feature value by detecting an average value of luminance of each pixel making up each frame within one frame space of said first frame; and a black inserting signal computing section to calculate a black inserting signal to set a gray level of said black frame based on said display gray-level feature value.

5. The image display device according to claim 4, wherein said black inserting signal computing section is so configured as and calculate and generate said black inserting signal by performing specified conversion on said display gray-level feature value extracted by said display gray-level feature value extracting section.

6. An image display device in which a black frame is inserted between a first frame and a second frame, said second frame succeeding the first frame, wherein the frames make up a moving picture, comprising:

a black frame gray-level controlling section to change a gray level of said black frame to be inserted immediately after said first frame based on a gray level of said first frame, wherein said black frame gray-level controlling section comprises, a display gray-level feature value extracting section to partition said first frame into a plurality of matrix-like blocks and to extract a display gray-level feature value corresponding to a gray level of each of said blocks in said first frame; and a black inserting signal computing section to calculate to generate a block black inserting signal to set a gray level of said black frame to each of said blocks based on each said display gray-level feature value and to calculate and generate a black inserting signal to set a gray level of said black frame by performing spatial interpolation on each said block black inserting signal in each boundary among the blocks.

7. The image display device according to claim 6, wherein said display gray-level feature value extracting section is so configured as to extract said display gray-level feature value based on frequency of occurrence of a gray level of each of said blocks in each frame of said moving picture and wherein said black inserting signal computing section is so configured as to detect a minimum gray level whose frequency of occurrence exceeds a specified threshold value in each of the blocks in each frame of said moving picture based on said display gray-level feature value and to calculate and generate said black inserting signal by smoothing said minimum gray level of a specified number of frames of said moving picture.

8. The image display device according to claim 6, wherein said black frame gray-level controlling section comprises:

a display gray-level feature value extracting section to partition said first frame into a plurality of matrix-like blocks and to extract said display gray-level feature value by detecting an average value of luminance of each pixel making up each block in said first frame; and a black inserting signal computing section to calculate a block black inserting signal to set a gray level of said black frame to each said block based on said display gray-level feature value and to generate a black inserting signal to set a gray level of said black frame by performing spatial interpolation on each said block gray-level inserting signal in each boundary among blocks.

9. A driving circuit to be used in an image display device in which a black frame is inserted between a first and a second frame, said second frame succeeding the first frame, wherein the frames make up a moving picture, comprising:

a black frame gray-level controlling section to change a gray level of said black frame to be inserted immediately after said first frame, based on a gray level of said first frame, wherein said black frame gray-level controlling section comprises:

a display gray-level feature value extracting section to extract a display gray-level feature value corresponding to a gray level of first frame; and a black inserting signal computing section to calculate and generate a black inserting signal to set a gray level to said black frame based on said display gray-level feature value.

10. A driving method to be used in an image display device in which a black frame is inserted between a first and a second frame, said second frame succeeding the first frame, wherein the frames make up a moving picture, comprising:

changing a gray level of said black frame to be inserted immediately after said first frame based on a gray level of said first frame, extracting a display gray-level feature value corresponding to a gray level of said first frame; and calculating and generating a black inserting signal to set a gray level to said black frame based on said display gray-level feature value.

11. An image display device in which a black frame is inserted between a first frame and a second frame, said second frame succeeding the first frame, wherein the frames make up a moving picture, comprising;

a black frame gray-level controlling means to change a gray level of said black frame to be inserted immediately after said first frame based on a gray level of said first frame;

wherein said black frame gray-level controlling means comprises:

a display gray-level feature value extracting means to extract a display gray-level feature value corresponding to a gray level of said first frame; and a black inserting signal computing means to calculate to generate a black inserting signal to set a gray level to said black frame based on said display gray-level feature value.

12. The image display device according to claim 11, wherein said display gray-level feature value extracting means is so configured as to extract said display gray-level feature value by detecting frequency of occurrence of a gray level of each frame within one frame space of said first frame and wherein said black inserting signal computing means is so configured as to calculate to generate said black inserting signal having a level corresponding to said display gray-level feature value.

13. The image display device according to claim 11, wherein said black inserting signal computing means detects a minimum gray level whose frequency of occurrence exceeds a specified threshold value in each frame of said moving picture based on said display gray-level feature value extracted by said display gray-level feature value extracting means and calculates to generate said black inserting signal by smoothing said minimum gray level of a specified number of frames of said moving picture.

14. The image display device according to claim 11, wherein said black frame gray-level controlling means comprises:

a display gray-level feature value extracting means to extract said display gray-level feature value by detecting an average value of luminance of each pixel making up each frame within one frame space of said first frame; and a black inserting signal computing means to calculate a black inserting signal to set a gray level of said black frame based on said display gray-level feature value.

15. The image display device according to claim 14, wherein said black inserting signal computing means is so configured as to calculate and generate said black inserting signal by performing specified conversion on each said display gray-level feature value extracted by said display gray-level feature value extracting means.

16. An image display device in which a black frame is inserted between a first frame and a second frame, said second frame succeeding the first frame, wherein the frames make up a moving picture, comprising:

a black frame gray-level controlling means to change a gray level of said black frame to be inserted immediately after said first frame based on a gray level of said first frame;

a display gray-level feature value extracting means to partition said first frame into a plurality of matrix-like blocks and to extract a display gray-level feature value corresponding to a gray level of each of said blocks in said first frame; and a black inserting signal computing means to calculate to generate a block black inserting signal to set a gray level of said black frame to each of said blocks based on each said display gray-level feature value and to calculate and generate a black inserting signal to set a gray level of said black frame by performing spatial interpolation on each said block black inserting signal in each boundary among the blocks.

17. The image display device according to claim 16, wherein said display gray-level feature value extracting means is so configured as to extract said display gray-level feature value based on frequency of occurrence of a gray level of each of said blocks in each frame of said moving picture and wherein said black inserting signal computing means is so configured as to detect a minimum gray level whose frequency of occurrence exceeds a specified threshold value in each of blocks in each frame of said moving picture based on said display gray-level feature value and calculate and generate said black inserting signal by smoothing said minimum gray level of a specified number of frames of said moving picture.

18. The image display device according to claim 16, wherein said black frame gray-level controlling means comprises:

a display gray-level feature value extracting means to partition said first frame into a plurality of matrix-like blocks and to extract said display gray-level feature value by detecting an average value of luminance of each pixel making up each block in said first frame; and a black inserting signal computing means to calculate a block black inserting signal to set a gray level of said black frame to each said block based on said display gray-level feature value and to generate a black inserting signal to set a gray level of said black frame by performing spatial interpolation on each said block gray-level inserting signal in each boundary among blocks.

* * * * *